US010180073B2

(12) United States Patent
Tuertscher et al.

(10) Patent No.: US 10,180,073 B2
(45) Date of Patent: Jan. 15, 2019

(54) MOUNTING APPARATUS FOR LOW-DUCTILITY TURBINE NOZZLE

(71) Applicant: General Electric Company, Schenectady, NY (US)

(72) Inventors: Michael Ray Tuertscher, Cincinnati, OH (US); Darrell Glenn Senile, Cincinnati, OH (US); Greg Phelps, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 314 days.

(21) Appl. No.: 14/910,118

(22) PCT Filed: Aug. 6, 2014

(86) PCT No.: PCT/US2014/049843
§ 371 (c)(1),
(2) Date: Feb. 4, 2016

(87) PCT Pub. No.: WO2015/021086
PCT Pub. Date: Feb. 12, 2015

(65) Prior Publication Data

US 2016/0177759 A1 Jun. 23, 2016

Related U.S. Application Data

(60) Provisional application No. 61/862,818, filed on Aug. 6, 2013.

(51) Int. Cl.
*F01D 9/04* (2006.01)
*F01D 5/28* (2006.01)
*F01D 25/24* (2006.01)

(52) U.S. Cl.
CPC ..... *F01D 9/041* (2013.01); *F01D 5/282* (2013.01); *F01D 5/284* (2013.01); *F01D 9/042* (2013.01);
(Continued)

(58) Field of Classification Search
CPC ..... F01D 9/041; F01D 9/042; F01D 25/246; F01D 5/284; F01D 5/282; F05D 2300/6033; F05D 2240/128
See application file for complete search history.

(56) References Cited

U.S. PATENT DOCUMENTS 4,552,509 A 11/1985 Schweikl et al.
5,211,536 A 5/1993 Ackerman et al.
(Continued)

FOREIGN PATENT DOCUMENTS

CN 1441149 A 9/2003
CN 102132009 A 7/2011
(Continued)

OTHER PUBLICATIONS

International Search Report and Written Opinion issued in connection with corresponding PCT application PCT/US2014/049843 dated Jan. 15, 2015.
(Continued)

*Primary Examiner* — Christopher Verdier
*Assistant Examiner* — Maxime Adjagbe
(74) *Attorney, Agent, or Firm* — General Electric Company; William Andes

(57) ABSTRACT

A turbine nozzle includes an arcuate inner band having opposed flowpath and back sides, and an aft flange extending outward from the back side; an arcuate outer band having opposed flowpath and back sides; an airfoil-shaped turbine vane extending between the flowpath sides of the inner and outer bands, wherein the inner and outer bands and the vane comprise a ceramic low-ductility material; and a metallic collar surrounding the aft flange.

9 Claims, 8 Drawing Sheets

(52) U.S. Cl.
CPC ..... *F01D 25/246* (2013.01); *F05D 2220/32* (2013.01); *F05D 2220/3212* (2013.01); *F05D 2230/237* (2013.01); *F05D 2240/128* (2013.01); *F05D 2260/30* (2013.01); *F05D 2300/10* (2013.01); *F05D 2300/20* (2013.01); *F05D 2300/518* (2013.01); *F05D 2300/6033* (2013.01)

(56) References Cited

U.S. PATENT DOCUMENTS

| | | | | |
|---|---|---|---|---|
| 8,206,096 | B2 * | 6/2012 | Prentice | F01D 5/282 415/191 |
| 2003/0161726 | A1 | 8/2003 | Lu | |
| 2009/0155069 | A1 * | 6/2009 | Durocher | F01D 9/042 415/209.3 |
| 2011/0008156 | A1 | 1/2011 | Prentice | |
| 2011/0229314 | A1 | 9/2011 | Dakowski et al. | |
| 2014/0227088 | A1 | 8/2014 | Beaujard et al. | |
| 2014/0314556 | A1 * | 10/2014 | Fremont | F01D 5/282 415/200 |

FOREIGN PATENT DOCUMENTS

| | | | |
|---|---|---|---|
| EP | 1126135 | A2 | 8/2001 |
| EP | 1795705 | A2 | 6/2007 |
| EP | 2412928 | A1 | 2/2012 |
| FR | 2979662 | A1 | 3/2013 |
| FR | 2981602 | A1 | 4/2013 |

OTHER PUBLICATIONS

Unofficial English Translation of China Office Action issued in connection with corresponding CN Application No. 201480044752.6 dated Aug. 1, 2016.

* cited by examiner

MOUNTING APPARATUS FOR LOW-DUCTILITY TURBINE NOZZLE

BACKGROUND OF THE INVENTION

Embodiments of the present invention relate generally to gas turbine engines, and more particularly to turbine nozzles for such engines incorporating airfoils made of a low-ductility material.

A typical gas turbine engine includes a turbomachinery core having a high pressure compressor, a combustor, and a high pressure turbine in serial flow relationship. The core is operable in a known manner to generate a primary gas flow. The high pressure turbine (also referred to as a gas generator turbine) includes one or more stages which extract energy from the primary gas flow. Each stage comprises a stationary turbine nozzle followed by a downstream rotor carrying turbine blades. These components operate in an extremely high temperature environment, and must be cooled by air flow to ensure adequate service life. Typically, the air used for cooling is extracted (bled) from the compressor. Bleed air usage negatively impacts specific fuel consumption ("SFC") and should generally be minimized.

Metallic turbine structures can be replaced with materials having better high-temperature capabilities, such as ceramic matrix composites ("CMCs"). The density of CMCs is approximately one-third of that of conventional metallic superalloys used in the hot section of turbine engines, so by replacing the metallic alloy with CMC while maintaining the same part geometry, the weight of the component decreases, as well as the need for cooling air flow.

While CMC materials are useful in turbine components, they require additional design considerations when being mounted to other components as compared to their metallic counterparts. CMC materials have relatively low tensile ductility or low strain to failure when compared with metals. Also, CMCs have a coefficient of thermal expansion ("CTE") approximately one-third that of superalloys. The allowable stress limits for CMCs are also lower than metal alloys which drives a need for simple and low stress design for CMC components.

Transferring loads out of a ceramic component is best done by distributing the load across large areas, rather than using point or line contacts. Unfortunately, rocking motion of a component such as a turbine nozzle, due to the thermal mismatch of the structural components, along with prior art pinned configurations, tends to introduce line contacts.

Prior art CMC turbine nozzles have utilized contoured contact areas to help to control the line contact as the nozzle rocked relative to the structures, and pins were replaced by adding pads to the structural hardware. However, these modifications increase the complexity and machining processes required to manufacture the structure.

Accordingly, there is a need for an apparatus for mounting CMC and other low-ductility turbine nozzles that minimizes mechanical loads on those components, with minimum complexity.

BRIEF DESCRIPTION OF THE INVENTION

This need is addressed by embodiments of the present invention, which provide a turbine nozzle including non-structural airfoils which are positioned and retained to a surrounding structure while permitting limited freedom of movement.

According to one aspect of the invention, a turbine nozzle includes: an arcuate inner band having opposed flowpath and back sides, and an aft flange extending outward from the back side; an arcuate outer band having opposed flowpath and back sides; an airfoil-shaped turbine vane extending between the flowpath sides of the inner and outer bands, wherein the inner and outer bands and the vane comprise a ceramic low-ductility material; and a metallic collar surrounding the aft flange.

According to another aspect of the invention, the collar has an arcuate shape with opposed forward and aft faces, opposed first and second end faces, and opposed upper and lower faces, the upper face disposed adjacent the back side of the inner band; and a slot passes through the collar from the upper face to the lower face, and the aft flange is received in the slot.

According to another aspect of the invention, the collar has an arcuate shape with opposed forward and aft faces, opposed first and second end faces, and opposed upper and lower faces, the upper face disposed adjacent the back side of the inner band; and a transversely-extending rail protrudes from the aft face of the collar.

According to another aspect of the invention, the collar has an arcuate shape with opposed forward and aft faces, opposed first and second end faces, and opposed upper and lower faces, the upper face disposed adjacent the back side of the inner band; a slot passes through the collar from the upper face to the lower face, and the aft flange is received in the slot; and the aft flange has a T-shape and an interior of the slot has shape complementary to the aft flange.

According to another aspect of the invention, the collar has an arcuate shape with opposed forward and aft faces, opposed first and second end faces, and opposed upper and lower faces, the upper face positioned facing the back side of the inner band; on the first end face 40 of the collar, a lower or radially inner portion 58 is recessed relative to an upper or radially outer portion 60; and on the second end face 42 of the collar, an upper or radially outer portion 62 is recessed relative a lower or radially inner portion 64.

According to another aspect of the invention, the inner band includes a forward flange extending outward from the back side, spaced-apart from the aft flange.

According to another aspect of the invention, the collar is secured to the aft flange by a metallic pin passing through aligned holes in the collar and the aft flange.

According to another aspect of the invention, the pin is secured to the collar by a weld or braze joint.

According to another aspect of the invention, a leaf seal is attached to the forward flange by a metallic pin passing through aligned holes in the leaf seal and the forward flange.

According to another aspect of the invention, metallic, U-shaped mounting clip is mounted over the forward flange; the pin passes through aligned holes in the mounting clip and the forward flange; and the pin is secured to the mounting clip by a weld or braze joint.

According to another aspect of the invention, the outer band, inner band, and vane are part of a monolithic whole.

According to another aspect of the invention, two or more vanes are disposed between the inner and outer bands.

According to another aspect of the invention, a turbine nozzle assembly includes a plurality of the turbine nozzles arranged in an annular array, wherein: each collar has an arcuate shape with opposed forward and aft faces, opposed first and second end faces, and opposed upper and lower faces, the upper face positioned facing the back side of the inner band; on the first end face of the collar, a radially inner portion is recessed relative to a radially outer portion; and on the second end face of the collar, a radially outer portion is recessed relative a radially inner portion; and the end faces of the collars of adjacent turbine nozzles are mutually engaged with each other.

According to another aspect of the invention, a transversely-extending rail protrudes from the aft face of each of the collars; and the annular array of turbine nozzles are disposed abutting an annular structural component, with the rails bearing against the annular structure.

According to another aspect of the invention, each of the collars are attached to the annular structural component with pins passing through aligned holes in the collar and the annular structural component.

BRIEF DESCRIPTION OF THE DRAWINGS

Embodiments of the present invention may be best understood by reference to the following description taken in conjunction with the accompanying drawing figures in which.

DETAILED DESCRIPTION OF THE INVENTION

Figure 1:
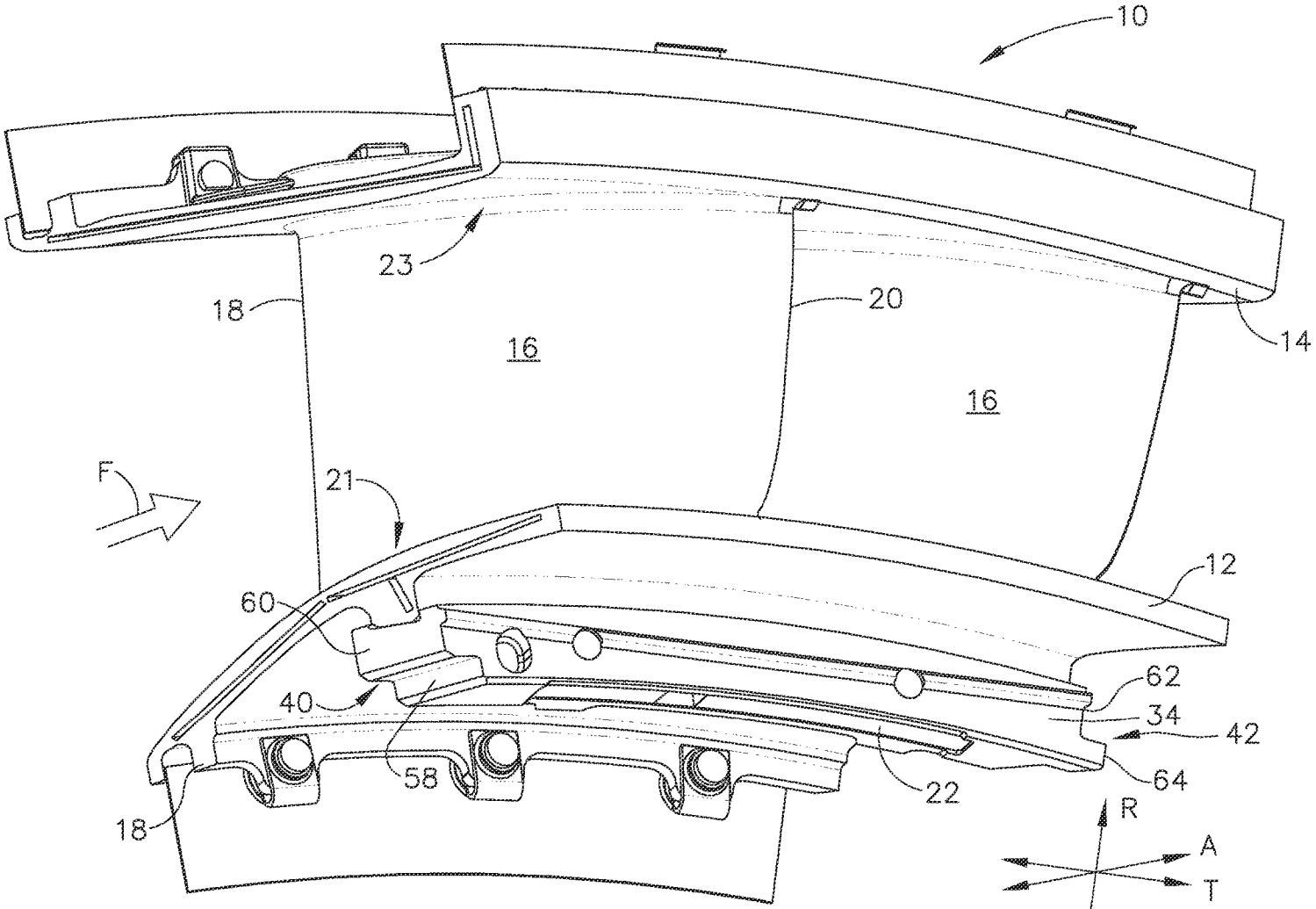
FIG. 1 is a schematic perspective view of a turbine nozzle assembly for a gas turbine engine, constructed according to an aspect of the present invention.
Figure 2:
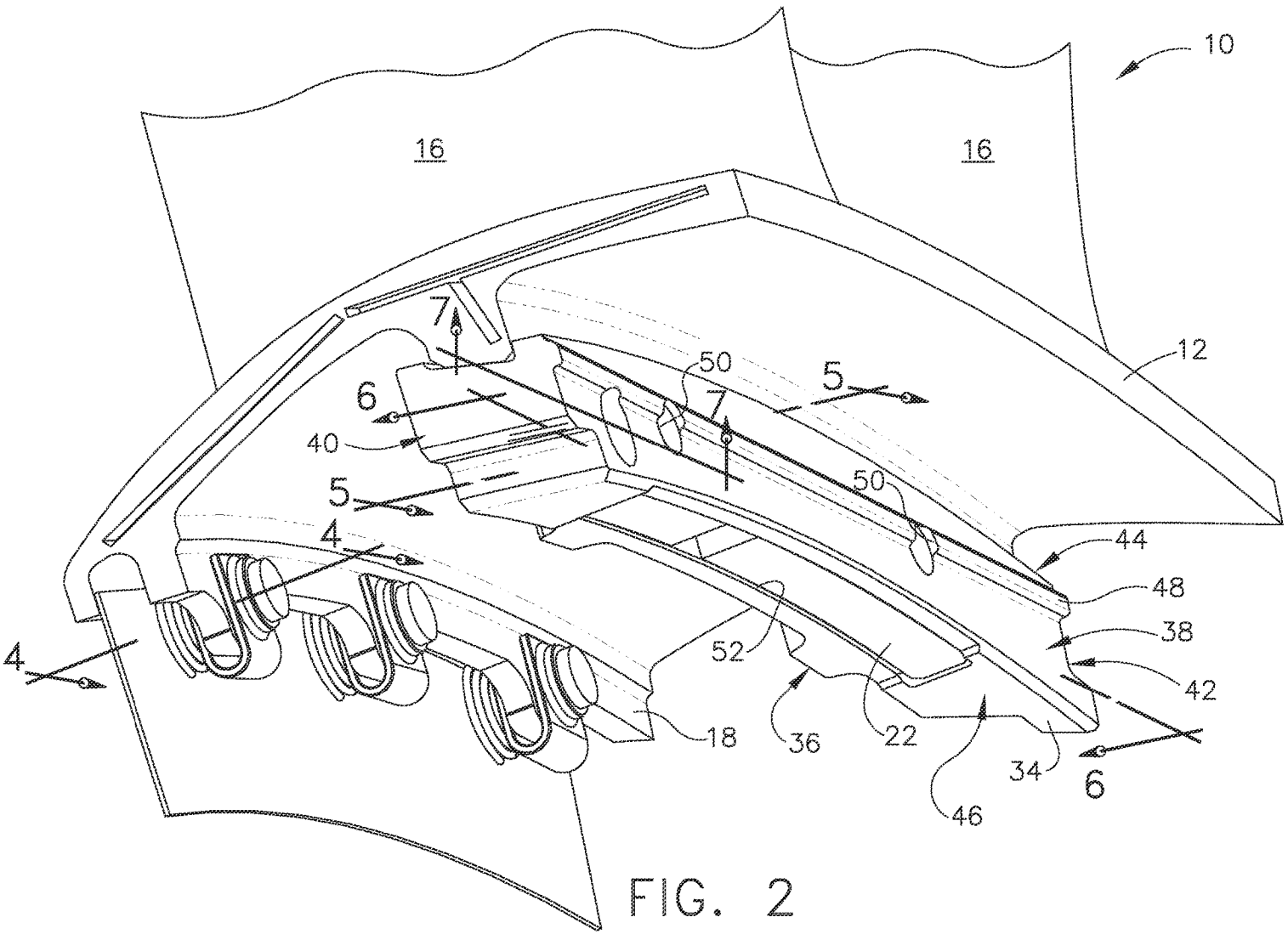
FIG. 2 is an enlarged view of a portion of the turbine nozzle shown in FIG. 1.
Figure 3:
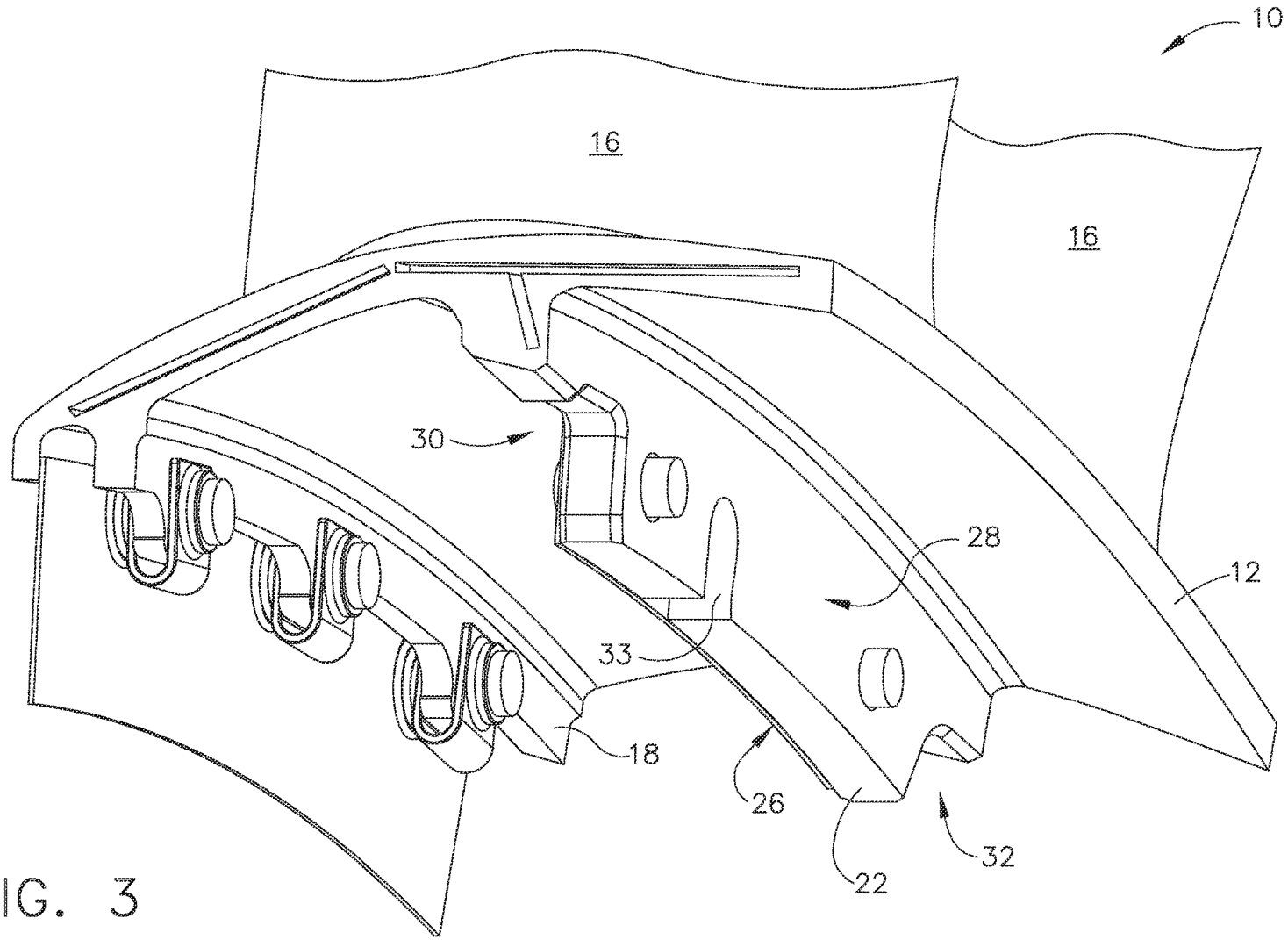
FIG. 3 is an enlarged view of a portion of the turbine nozzle shown in FIG. 1.

Referring to the drawings wherein identical reference numerals denote the same elements throughout the various views, FIGS. 1-3 depict an exemplary turbine nozzle 10 constructed according to an aspect of the present invention. The turbine nozzle 10 is a stationary component forming part of a turbine section of a gas turbine engine. It will be understood that the turbine nozzle 10 would be mounted in a gas turbine engine upstream of a turbine rotor having a rotor disk (not shown) carrying an array of airfoil-shaped turbine blades, the nozzle and the rotor defining one stage of the turbine. The primary function of the nozzle 10 is to direct the combustion gas flow into the downstream turbine rotor stage.

A turbine is a known component of a gas turbine engine of a known type, and functions to extract energy from high-temperature, pressurized combustion gases from an upstream combustor (not shown) and to convert the energy to mechanical work, which is then used to drive a compressor, fan, shaft, or other mechanical load (not shown). The principles described herein are equally applicable to turbofan, turbojet and turboshaft engines, as well as turbine engines used for other vehicles or in stationary applications.

It is noted that, as used herein, the term "axial" or "longitudinal" refers to a direction parallel to an axis of rotation of a gas turbine engine, while "radial" refers to a direction perpendicular to the axial direction, and "tangential" or "circumferential" refers to a direction mutually perpendicular to the axial and tangential directions. (See arrows "A", "R", and "T" in FIG. 1). As used herein, the terms "forward" or "front" refer to a location relatively upstream in an air flow passing through or around a component, and the terms "aft" or "rear" refer to a location relatively downstream in an air flow passing through or around a component. The direction of this flow is shown by the arrow "F" in FIG. 1. These directional terms are used merely for convenience in description and do not require a particular orientation of the structures described thereby.

The turbine nozzle 10 includes an annular inner band 12 and an annular outer band 14, which define the inner and outer boundaries, respectively, of a hot gas flowpath through the turbine nozzle 10.

An array of airfoil-shaped turbine vanes (or simply "vanes") 16 is disposed between the inner band 12 and the outer band 14. Each vane 16 has opposed concave and convex sides extending between a leading edge 18 and a trailing edge 20, and extends between a root end 21 and a tip end 23. Each of the inner band 12 and the outer band 14 has a flowpath side, facing the vanes 16, and an opposed back side. In the illustrated example, the nozzle 10 is a segment of a larger annular structure and includes two vanes 16. This configuration is commonly referred to as a "doublet." The principles of the embodiments of the present invention are equally applicable to a nozzle having a single vane or to segments having more than two vanes.

The inner and outer bands 12 and 14 and the vanes 16 part of a monolithic whole constructed from a low-ductility, high-temperature-capable material. One example of a suitable material is a ceramic matrix composite (CMC) material of a known type. Generally, commercially available CMC materials include a ceramic type fiber for example silicon carbide (SiC), forms of which are coated with a compliant material such as boron nitride (BN). The fibers are carried in a ceramic type matrix, one form of which is SiC. Typically, CMC type materials have a room temperature tensile ductility of no greater than about 1%, herein used to define and mean a "low ductility material." Generally CMC-type materials have a room temperature tensile ductility in the range of about 0.4% to about 0.7%. This is compared with metals typically having a room temperature tensile ductility of at least about 5%, for example in the range of about 5% to about 15%.

Figure 4:
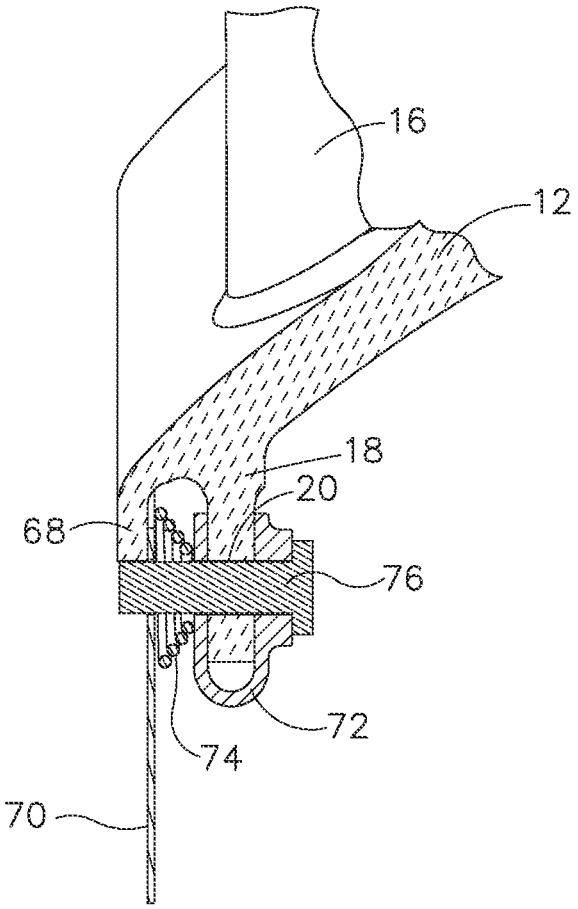
FIG. 4 is a sectional view taken along lines 4-4 of FIG. 2.

Referring to FIG. 2, the inner band 12 includes a forward flange 18 extending radially inward near its forward end (or in other words, away from the inner band's back side). A series of forward holes 20 (see FIG. 4) which are generally axially aligned are spaced apart along the forward flange 18. The inner band 12 also includes an aft flange 22 extending radially inward (or in other words, away from the inner band's back side) near a mid-chord position. As best seen in FIG. 4, a series of aft holes 24 which are generally axially aligned are spaced apart along the aft flange 22. The aft flange 22 has a "T" shape when viewed in front or rear elevation, or could also be described as having an arcuate shape with notched corners. The aft flange 22 includes opposed forward and aft faces 26 and 28, and opposed end faces 30 and 32. A radially-extending slot 33 is formed in the aft flange 22.

A collar 34 is provided to engage the aft flange 22 for the purpose of mounting the turbine nozzle 10 in position and transferring tangential, radial, and axial loads from the turbine nozzle 10 to the supporting structural hardware, with the effect of eliminating line loading on the turbine nozzle 10.

The collar 34 is a monolithic metallic component, and may be formed by conventional methods such as casting, forging, machining from billet, etc. As seen in FIG. 2, it has an elongated, arcuate, block-like shape with opposed forward and aft faces 36 and 38, opposed first and second end faces 40 and 42, and opposed upper and lower faces 44 and 46. The upper and lower faces 44 and 46 are arcuate and generally parallel to each other. The aft face 38 is generally planar. A transversely-extending rail 48 protrudes axially aft from the aft face 38. The rail 48 lies along a chord of the circular shape defined by the upper face 44. Two or more mounting holes 50 extend axially through the collar 34 from the aft face 38 to the forward face 36.

Figure 6:
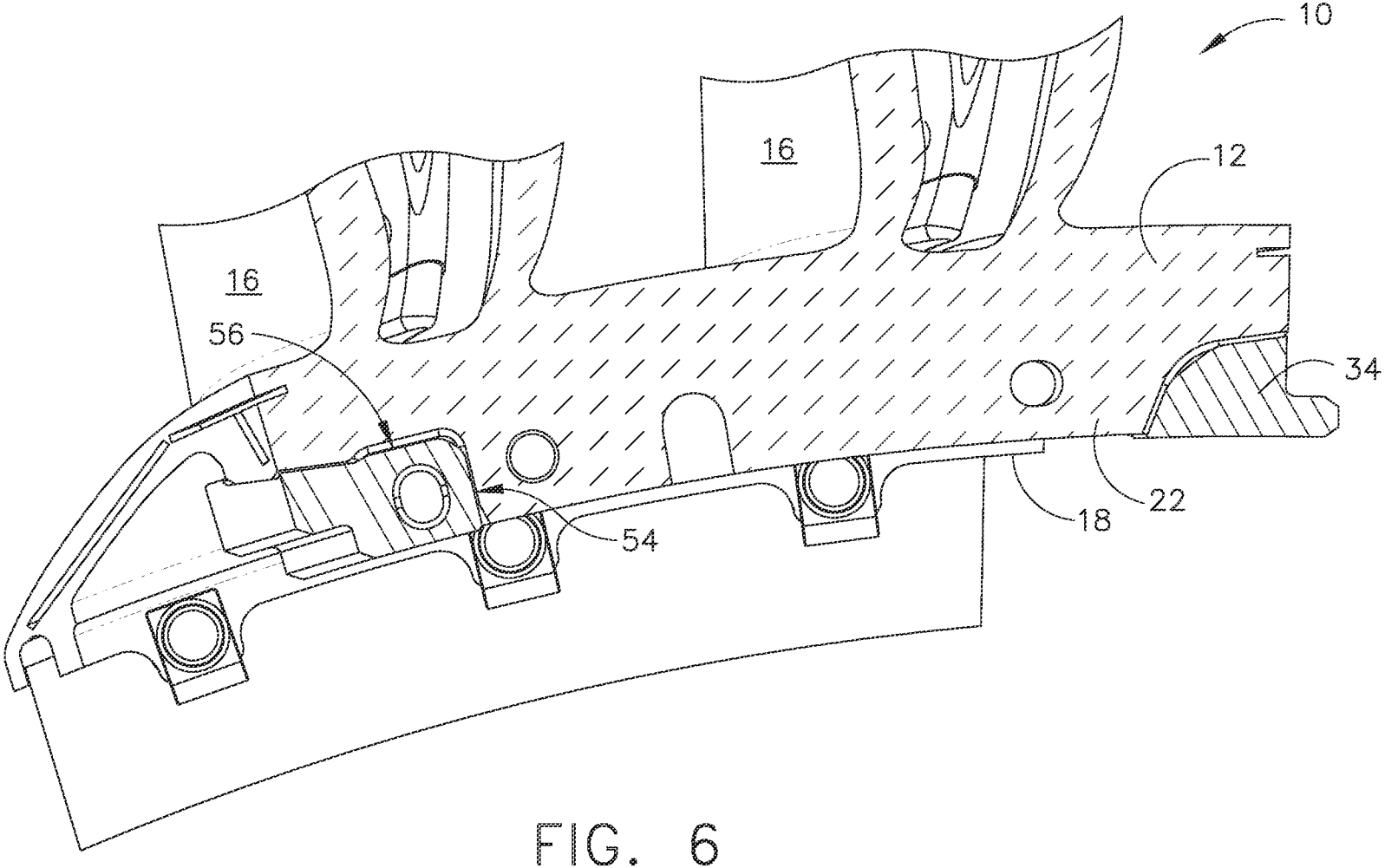
FIG. 6 is a sectional view taken along lines 6-6 of FIG. 2.
Figure 7:
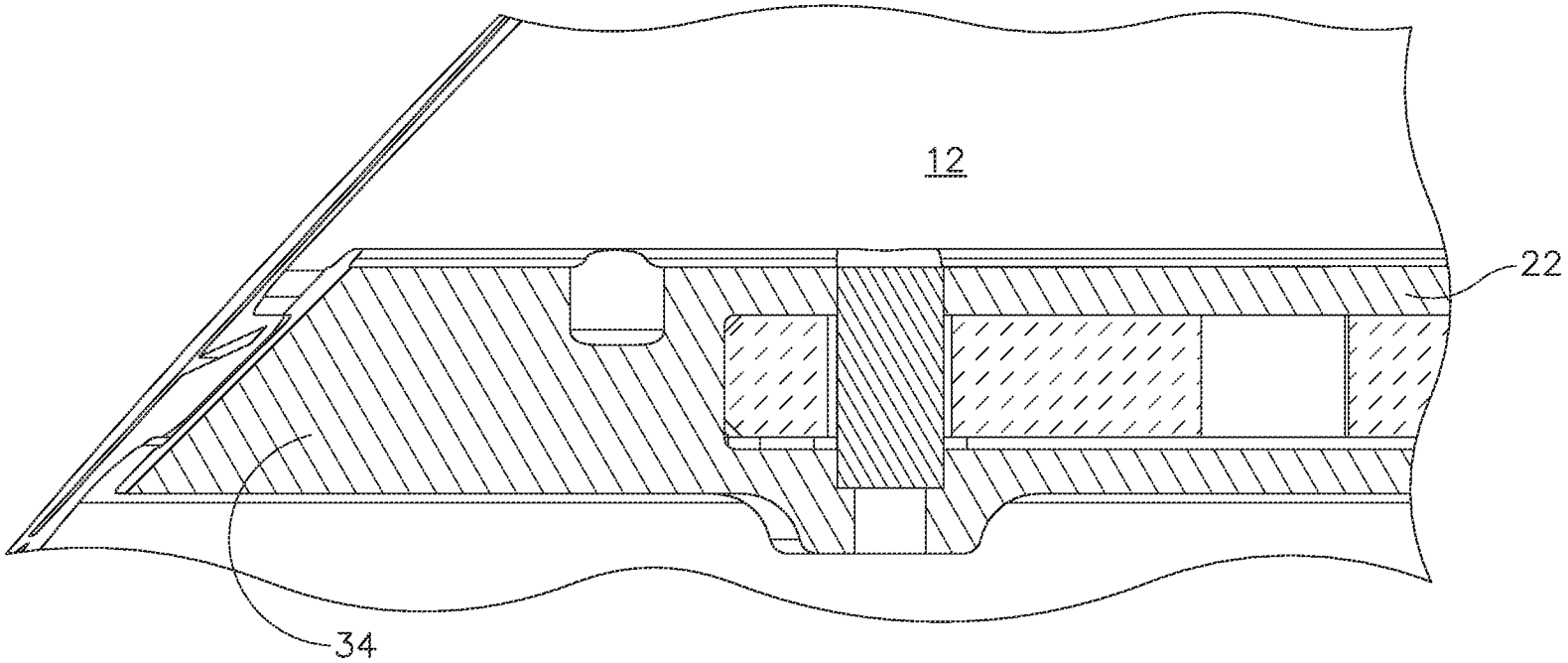
FIG. 7 is a sectional view taken along lines 7-7 of FIG. 2.

A slot 52 passes through the collar 34 between the upper and lower faces 44 and 46. The slot 52 has a "stepped" shape which is complementary to the shape of the aft flange 22. More specifically, an upper or radially outer portion of the slot 52 has a greater tangential width than a lower or radially inner portion. The relationship of the slot 52 to the aft flange 22 can be seen more clearly in FIG. 6. The end portions of the slot 52 include surfaces that define tangential and radial pads 54 and 56, respectively.

The end faces 40 and 42 define an interlocking or overlapping pattern, also referred to herein as a "ship lap" pattern. Specifically, as seen in FIG. 1, on the first end face 40, a lower or radially inner portion 58 is recessed relative to an upper or radially outer portion 60. On the second end face 42, an upper or radially outer portion 62 is recessed relative a lower or radially inner portion 64. The overall effect is that the two radially inner portions 58 and 64 are laterally offset from the two radially outer portions 60 and 62.

Figure 5:
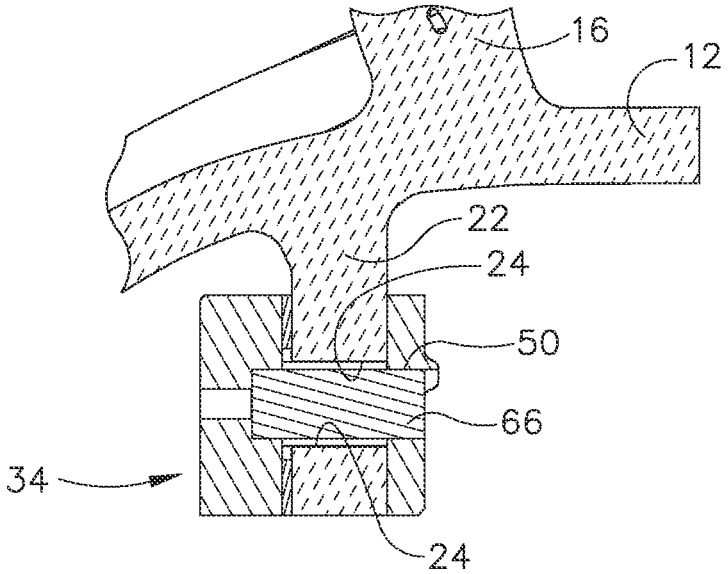
FIG. 5 is a sectional view taken along lines 5-5 of FIG. 2.

The collar is assembled to the turbine nozzle 10 with the aft flange 22 received in the slot 52. One or more pins 66 (see FIG. 5) pass through the mounting holes 50 in the collar 34 and the aft holes 24 in the aft flange 22, so as to retain the collar 34 to the aft flange 22. The pins 66 ensure that the collar 10 passes loads through the appropriate locations and remains in the proper position in a static condition and also while the engine is operating. The pins 66 may be secured in place, for example by welding or brazing to the collar 34.

As an option, one or more sealing elements may be mounted to the forward flange 18. In the illustrated example, best seen in FIG. 4, the inner band 12 includes a seal lip 68 positioned slightly forward of the forward flange 18. A laterally-elongated leaf seal 70 is positioned against the seal lip 68. A U-shaped metallic mounting clip 72 with a hole in each leg of the "U" is clipped over the forward flange 18, with the clip holes aligned to one of the forward holes 20 in the forward flange 18. A coil-type spring 74 is disposed between the forward flange 18 and the mounting clip 72, biasing the leaf seal 70 against the seal lip 68. A metallic seal pin 76 with an enlarged head passes through the holes in the forward flange 18, the mounting clip 72, the spring 74, and the leaf seal 70. The seal pin 76 may be secured in place, for example by welding or brazing it to the mounting clip 72. In operations, the leaf seal 70 functions to reduce or prevent air leakage between the turbine nozzle 10 and surrounding engine components (not shown).

In operation, gas pressure subjects the turbine nozzle 10 to axial, tangential, and radial load components. These loads are transferred from the turbine nozzle 10 through the aft flange 22 to the collar 34 through large surface area contacts, with the effect of eliminating line loading on the turbine nozzle 10. The collar 34 in turn replicates a configuration for transferring loads to adjacent structural components that would be used with a metal nozzle.

Figure 9:
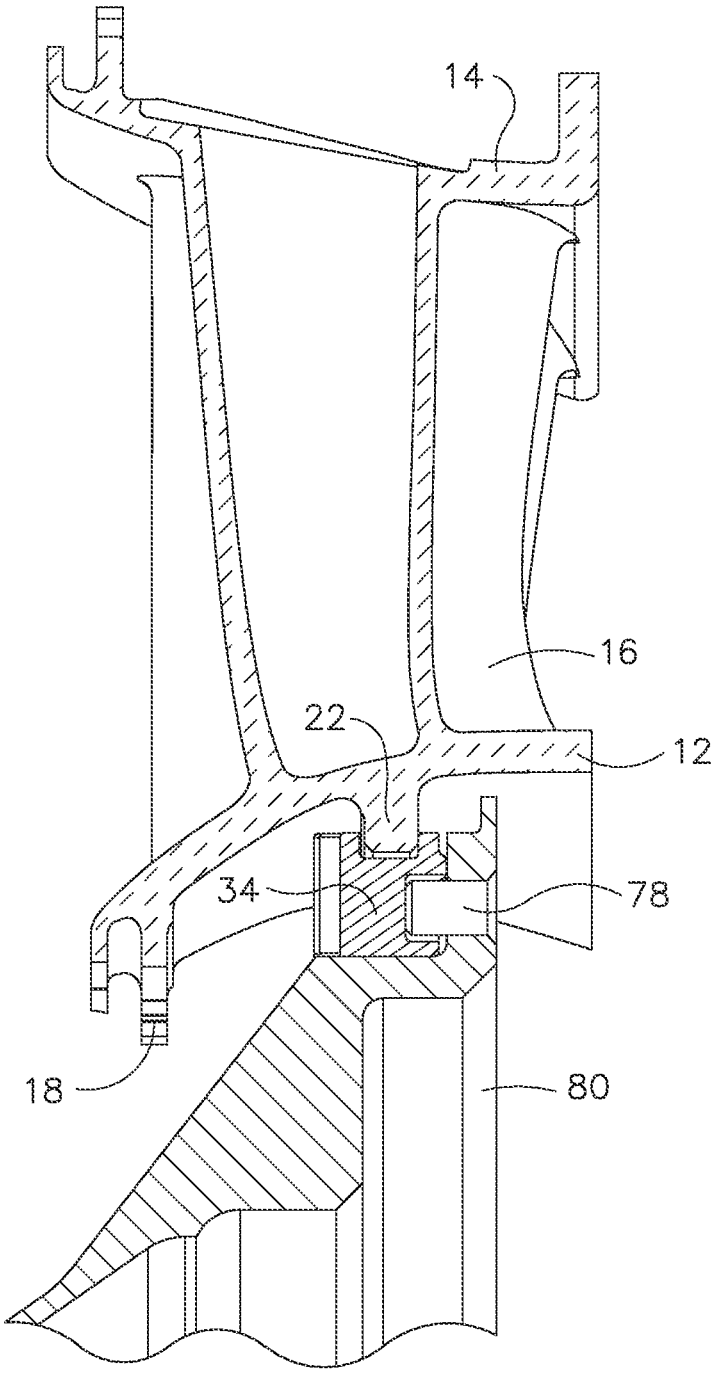
FIG. 9 is a cross-sectional view of the nozzle of FIG. 1 mounted to a surrounding structure.

The tangential load is transferred from the end face 30 of the aft flange 22 to the tangential pad 54 on the collar 34, and then through a reaction pin 78 which passes through the collar 34 and an adjacent structural component 80 (see FIG. 9). The pin reaction is a traditional configuration for a metal turbine nozzle and the collar-pad reaction reduces the line contact on the CMC material.

The axial load of the turbine nozzle 10 is passed from a large area of the aft flange 22 to the corresponding area on the collar 34. The collar 34 then passes that load to the structure through the rail 48 (see FIG. 9). The rail 48 acts as a chordal hinge, permitting the turbine nozzle 10 to rock, i.e. in a "pitching" motion about the rail 48, but reacting the axial load at a line contact. Since the collar 10 will rock in unison with the turbine nozzle 10, the contact between the turbine nozzle 10 and the collar 34 remains a large area contact (as opposed to a point or line contact).

Figure 8:
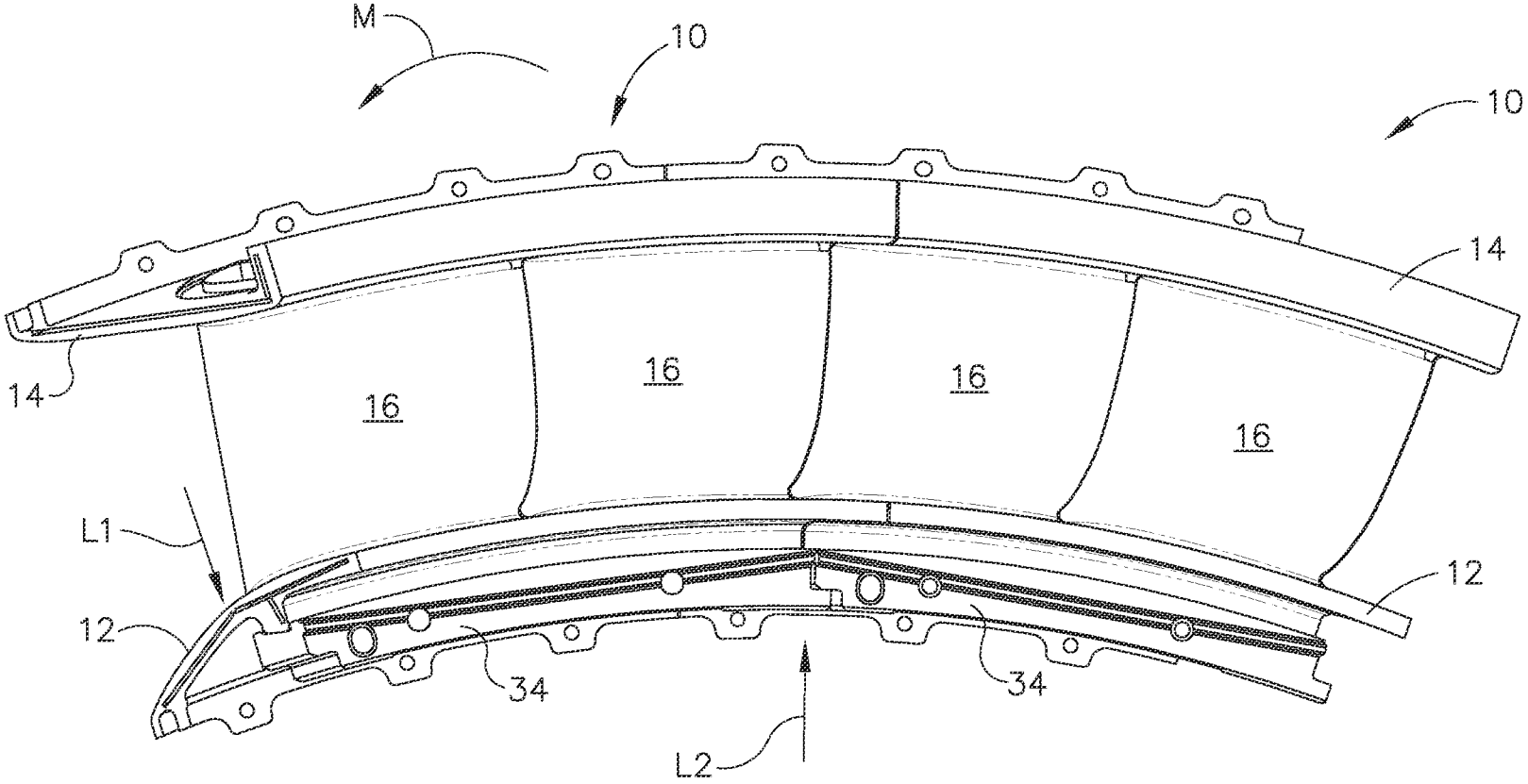
FIG. 8 is a rear perspective view showing two turbine nozzles of FIG. 1 assembled side-by-side.

As seen in FIG. 8, the turbine nozzle 10 experiences a turning moment, depicted by the arrow "M", resulting in a radially inward load "L1" and a radially outward load "L2". The turbine nozzle 10 passes the inward load L1 to the collar 10 through the radial pad 56 and the outward load L2 through the pin 66. The collar 10 transfers the inward load to the structural component 80 through direct contact between the lower face 46 and the structural component 80, and passes the outward load L2 to the adjacent collar 34 through the engaged end faces 40, 42 (or "ship lap").

The mounting apparatus described above has several advantages compared to the prior art. Introduction of the attachment collar allows permits use of CMC material in the turbine nozzle, with its lower weight and higher-temperature capabilities, allows contacts to be controlled in the CMC, and does not introducing additional complexity in the structural hardware as compared to prior art configurations.

The foregoing has described a turbine nozzle for a gas turbine engine and a mounting apparatus therefor. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying potential points of novelty, abstract and drawings), or to any novel one, or any novel combination, of the steps of any method or process so disclosed.

What is claimed is:

1. A turbine nozzle comprising:

an arcuate inner band having opposed flowpath and back sides, and an aft flange extending outward from the back side; and an arcuate outer band having opposed flowpath and back sides;

an airfoil-shaped turbine vane extending between the flowpath sides of the inner and outer bands, wherein the inner and outer bands and the vane comprise a ceramic low-ductility material; and a metallic collar surrounding the aft flange and wherein the collar has an arcuate shape with opposed forward and aft faces, opposed first and second end faces, and opposed upper and lower faces, the upper face disposed adjacent the back side of the inner band; and a slot passes through the collar from the upper face to the lower face, and the aft flange is received in the slot.

2. The turbine nozzle of claim 1 wherein the aft flange has a T-shape and an interior of the slot has shape complementary to the aft flange.

3. A turbine nozzle comprising:

an arcuate inner band having opposed flowpath and back sides, and an aft flange extending outward from the back side; and an arcuate outer band having opposed flowpath and back sides;

an airfoil-shaped turbine vane extending between the flowpath sides of the inner and outer bands, wherein the inner and outer bands and the vane comprise a ceramic low-ductility material; and a metallic collar surrounding the aft flange and wherein the collar has an arcuate shape with opposed forward and aft faces, opposed first and second end faces, and opposed upper and lower faces, the upper face disposed adjacent the back side of the inner band; and a transversely-extending rail protrudes from the aft face of the collar.

4. A turbine nozzle comprising:

an arcuate inner band having opposed flowpath and back sides, and an aft flange extending outward from the back side; and an arcuate outer band having opposed flowpath and back sides;

an airfoil-shaped turbine vane extending between the flowpath sides of the inner and outer bands, wherein the inner and outer bands and the vane comprise a ceramic low-ductility material; and a metallic collar surrounding the aft flange and wherein the collar has an arcuate shape with opposed forward and aft faces, opposed first and second end faces, and opposed upper and lower faces, the upper face positioned facing the back side of the inner band;

on the first end face of the collar, a lower or radially inner portion is recessed relative to an upper or radially outer portion; and on the second end face of the collar, an upper or radially outer portion is recessed relative a lower or radially inner portion.

5. A turbine nozzle comprising:

an arcuate inner band having opposed flowpath and back sides, and an aft flange extending outward from the back side; and an arcuate outer band having opposed flowpath and back sides;

an airfoil-shaped turbine vane extending between the flowpath sides of the inner and outer bands, wherein the inner and outer bands and the vane comprise a ceramic low-ductility material; and a metallic collar surrounding the aft flange wherein a leaf seal is attached to a forward flange by a metallic pin passing through aligned holes in the leaf seal and the forward flange and a metallic, U-shaped mounting clip is mounted over the forward flange;

the metallic pin passes through aligned holes in the mounting clip and the forward flange; and the metallic pin is secured to the mounting clip by a weld or braze joint.

6. The turbine nozzle of claim 5 wherein two or more vanes are disposed between the inner and outer bands.

7. A turbine nozzle assembly-comprising a plurality of turbine nozzles arranged in an annular array, each turbine nozzle comprising:

an arcuate inner band having opposed flowpath and back sides, and an aft flange extending outward from the back side; and an arcuate outer band having opposed flowpath and back sides;

an airfoil-shaped turbine vane extending between the flowpath sides of the inner and outer bands, wherein the inner and outer bands and the vane comprise a ceramic low-ductility material; and a metallic collar surrounding the aft flange and wherein each collar has an arcuate shape with opposed forward and aft faces, opposed first and second end faces, and opposed upper and lower faces, the upper face positioned facing the back side of the inner band; on the first end face of the collar, a radially inner portion is recessed relative to a radially outer portion; and on the second end face of the collar, a radially outer portion is recessed relative a radially inner portion; and the end faces of the collars of adjacent turbine nozzles are mutually engaged with each other.

8. The turbine nozzle assembly of claim 7 wherein a transversely-extending rail protrudes from the aft face of each of the collars; and the annular array of turbine nozzles are disposed abutting an annular structural component, with the rails bearing against the annular structure.

9. The turbine nozzle assembly of claim 8 wherein each of the collars are attached to the annular structural component with pins passing through aligned holes in the collar and the annular structural component.

* * * * *